United States Patent [19]

Lindahl

[11] 4,157,077

[45] Jun. 5, 1979

[54] WATER HEATER

[76] Inventor: John R. Lindahl, Hwy. 12, P.O. Box 40, Cheap Hill, Tenn. 37035

[21] Appl. No.: 854,721

[22] Filed: Nov. 25, 1977

[51] Int. Cl.[2] ..... F22B 9/04; F22D 7/04

[52] U.S. Cl. ..... 122/159; 122/406 R; 122/408 R

[58] Field of Search ..... 122/406 R, 407, 379, 122/381, 382, 383, 159, 408 R, 409, 410

[56] References Cited

U.S. PATENT DOCUMENTS

| | | | |
|---|---|---|---|
| 1,536,613 | 5/1925 | Lyons | 122/159 |
| 2,593,946 | 4/1952 | Weldy | 122/408 |
| 2,814,278 | 11/1957 | Cameron | 122/159 |
| 4,037,569 | 7/1977 | Bennett et al. | 122/383 |

FOREIGN PATENT DOCUMENTS

| | | | |
|---|---|---|---|
| 111802 | 10/1940 | Australia | 122/159 |

*Primary Examiner*—Kenneth W. Sprague

[57] ABSTRACT

A water heater including a watertight tank having a plurality of flue tubes extending between the tank bottom and the tank top and having a burner means mounted beneath the tank and a hot water outlet mounted in the top portion of the tank. An agitator assembly is mounted in the bottom portion of the tank and includes a ring-shaped tubular member and a secondary tubular member connected to the ring-shaped tube. The ring-shaped and secondary tubular members are provided with a plurality of openings in the sides thereof. The agitator assembly is connected to a source of water so that when hot water is periodically withdrawn from the top of the tank water will flow into the tank through the openings in the agitator assembly. Such openings are positioned so that water flowing from inside the tubular members into the tank will flow in a number of different horizontal directions to thereby produce a substantially uniform stirring action in the bottom portion of the tank. Such stirring action will cause any solid particles in the water to be circulated upwardly and carried from the tank to thus prevent accumulation of such particles in the bottom of the tank.

9 Claims, 3 Drawing Figures

WATER HEATER

BACKGROUND OF THE INVENTION

I. Field of the Invention

This invention relates to water heaters and more particularly to a water heater equipped with a specially designed agitator means which is effective to prevent accumulation of scale and other solid particles in the bottom portion thereof.

II. Description of the Prior Art

A longstanding problem in the water heater industry is the tendency of dissolved solid particles to precipitate out of the water being heated which particles will accumulate in the bottom of the tank causing adverse operation and tank longevity. To applicant's knowledge prior to the present invention there was nothing available to alleviate this serious problem except relatively expensive and complex electrostatic, electronic or chemical devices or systems. Accordingly, it is the principal object of this invention to provide a water heater construction wherein the adverse accumulations referred to are either eliminated or at least substantially reduced by a relatively inexpensive means.

SUMMARY OF THE INVENTION

A water heater comprising a watertight tank and a source of heat for heating the water in the tank. The tank is provided with a hot water outlet means at the top portion thereof and an agitator assembly mounted in the bottom portion thereof. The agitator assembly includes a ring-shaped tubular member positioned in the bottom of the tank closely adjacent the side wall of the tank. The tubular member is provided with a plurality of openings in a side thereof so that the water flowing from inside the member into the tank will flow in a substantially horizontal direction towards the central portion of the tank in a plane which is closely adjacent to the tank bottom. A connector means is provided for connecting the agitator assembly to a source of water.

DESCRIPTION OF THE PREFERRED EMBODIMENT

Figure 1:
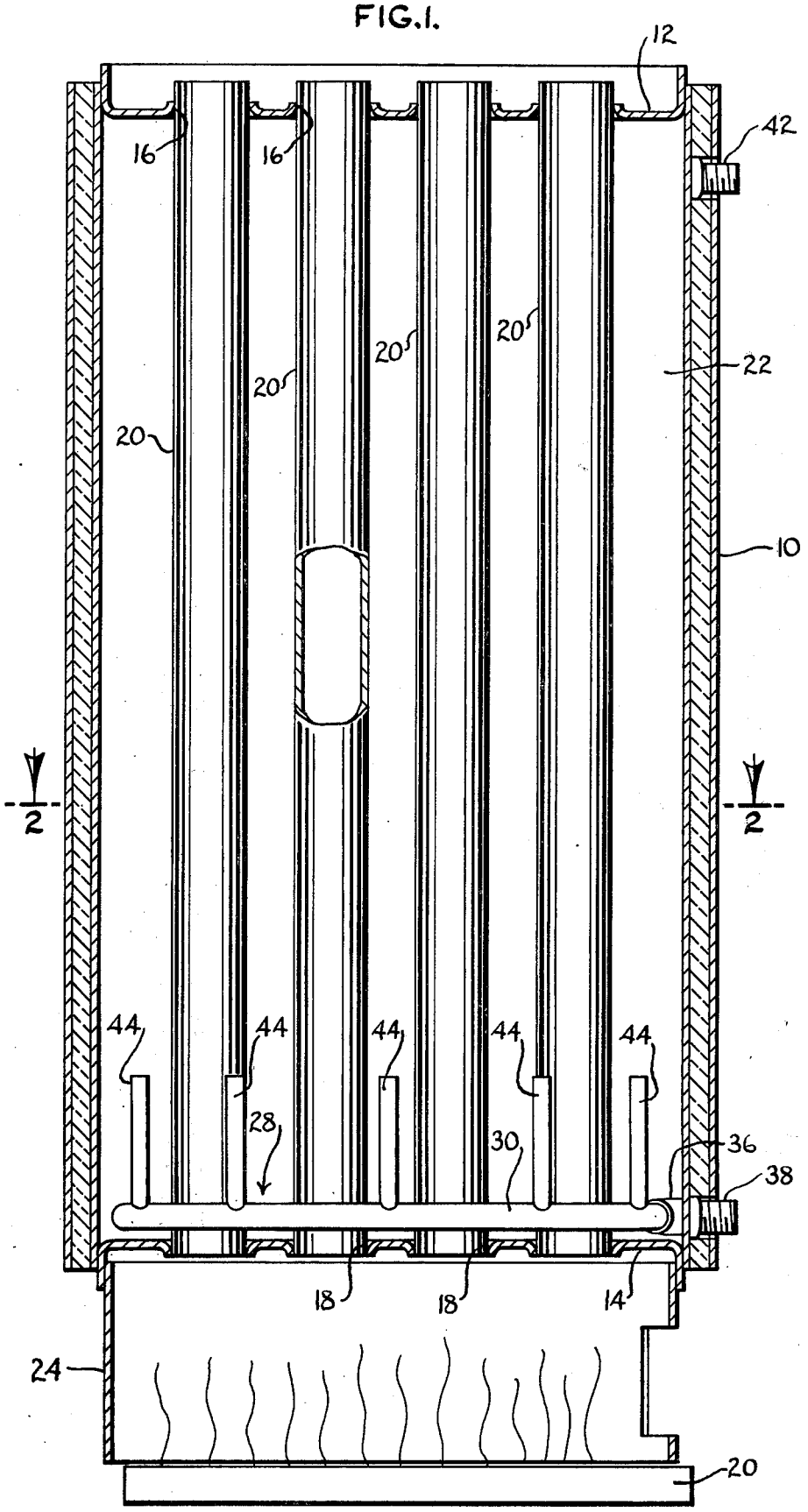
FIG. 1 is a side elevational view (with parts broken away) of a water heater which incorporates the subject matter of the present invention.

Referring to the drawings in detail, the water heater of the present invention is comprised of an insulated tank wall 10, a tank top member 12 and a tank bottom member 14. Top and bottom members 12 and 14 are provided with a plurality of aligned openings 16 and 18, respectively, in which flue tubes 20 are mounted. Tank top and bottom members 12 and 14 are sealed to the tank wall 10 and to the flue tubes 20 by any suitable means such as welding to form a liquidtight tank having a water heating chamber 22 within.

The water heater tank is mounted on a support base 24 which houses a burner 26 of conventional construction.

Figure 2:
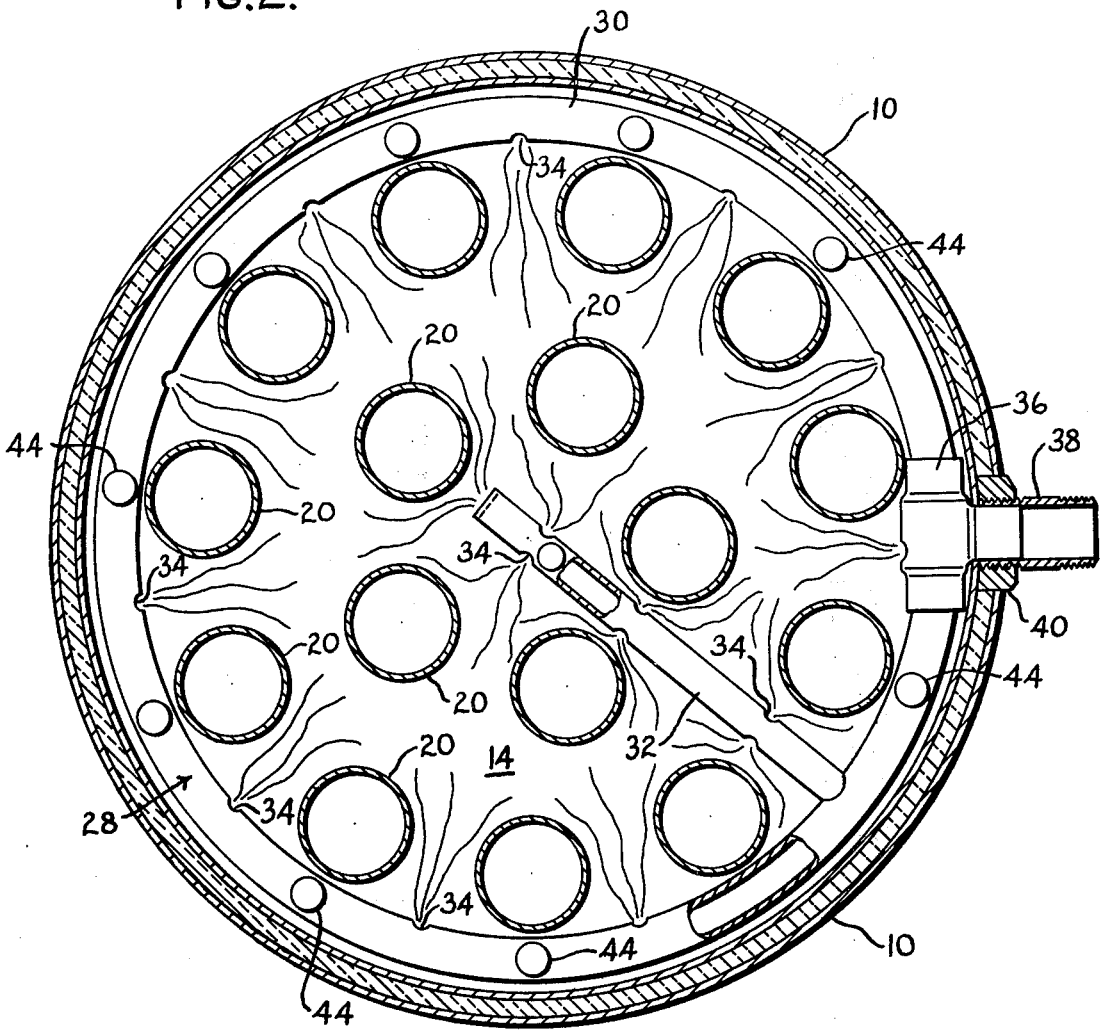
FIG. 2 is a sectional view taken along line 2—2 of FIG. 1.

Mounted in the lower portion of the tank chamber 22 is an agitator assembly 28 comprised of a circular ring portion 30 and a secondary straight tube portion 32 connected thereto. Ring portion 30 is dimensioned to fit between the outer row of flue tubes 20 and the inside wall of wall 10 as best shown in FIG. 2. Straight portion 32 of assembly 28 is dimensioned to extend from a connection point on the inner side of ring portion 30 between flue tubes 20 in a substantially radial direction towards the center of the chamber 22.

Both the ring portion 30 and the straight portion 32 of assembly 28 are provided with a plurality of openings 34 in the sides of the two portions and a single opening 36 in the end of portion 32.

The assembly 28 is provided with any suitable pipe fitting arrangement such as a T-fitting 36, a nipple 38 and a bushing 40 (as best shown in FIG. 2) for connecting the assembly to a source of water under pressure. A hot water outlet fitting 42 is provided at the upper portion of wall 10 as shown in FIG. 1.

To reduce corrosion of the metal parts of the water heater, a plurality of anode members 44 can be conveniently mounted on the upper surface of assembly 28 as shown in FIGS. 1 and 2. Anode members 44 may be of any suitable anodic material (i.e. higher on the galvanic scale than the tank material) which in the case of a steel tank would be made from aluminum, magnesium or zinc. The members 44 are in the form of round bars having one end thereof adhered to the top surfaces of the ring and straight portions 30 and 32 of assembly 28 as best shown in FIG. 2.

Figure 3:
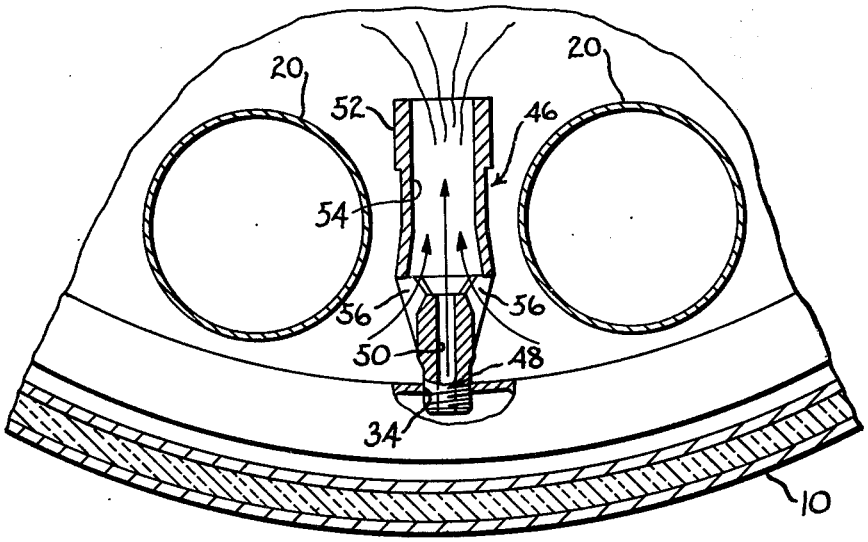
FIG. 3 is an enlarged fragmentary view similar to FIG. 2 but showing a modified embodiment of the invention.

As shown in FIG. 3, in a modified embodiment of the present invention one or more venturi fittings 46 can be mounted in openings 34 in portions 30 and 32 of the agitator assembly. Venturi fittings 44 are comprised of an externally threaded base portion 48 having a small diameter passageway 50 therethrough and a tip portion 52 having a larger diameter passageway 54 therethrough. A plurality of side openings 56 are provided adjacent the area where the end of passageway 50 opens into passageway 54.

By making venturi fittings 46 out of anodic material such as aluminum, magnesium or zinc, such fittings can serve a dual purpose, namely, as a means to increase the stirring action in the bottom of the tank and secondly, as a means to reduce corrosion of the metal parts of the tank. In such an installation the fittings may eventually disintegrate but in such event the stirring action would continue because of the liquid flowing out through openings 34.

OPERATION

The water in chamber 22 will be heated by the hot gasses and products of combustion passing through flue tubes 20 from burner 26. As previously explained, a not uncommon problem in the operation of water heaters of the type involved herein is the tendency (depending primarily on local water conditions) of certain dissolved solid materials in the water to precipitate out of the water being heated, which precipitated materials will settle out and accumulate in the bottom portion of the water heater tank. Such scale accumulations, if not periodically removed by some kind of a tank cleaning procedure, will gradually build up, creating an adverse effect on the heating efficiency of the unit and will ultimately cause a premature failure of the heater tank.

With the heater of the present invention when hot water is withdrawn from the chamber 22 through fitting 42 into a domestic water system, for example, cold water will simultaneously flow into the chamber through openings 34 in agitator portions 30 and 32 as shown by the wavy lines in FIG. 2. This substantially horizontal flow of multiple, spaced streams of water into chamber 22 at a level closely adjacent the bottom of the tank will create a substantially uniform stirring action throughout the lower portion of the tank. Such stirring action will cause any solid materials which have either settled to the bottom or is in the process of settling to the bottom to be maintained in suspension in the water. The normal upward circulation of the water in the tank, as it is heated, will cause such suspended particles to be carried upwardly in the tank and eventually out through outlet 42. Experience has shown that this periodic stirring action produced in the tank each time hot water is withdrawn therefrom, is effective to substantially reduce (and in some instances eliminate) harmful accumulations of scale in the bottom of the tank.

To provide an even more pronounced stirring effect (for larger size heaters, for example), venturi fittings 46 can be installed in one or more of the openings 34. As best shown in FIG. 3, as water flows out from small passageway 50 into larger passageway 54 of the venturi fitting, a venturi effect will be created causing water already in the tank to be drawn into the tip portion 52 of the fitting through openings 56 as shown by the arrows in FIG. 3. Such recirculation of water into the fitting through openings 56 will create an increased stirring effect in the area of each fitting.

I claim:

1. A water heater comprising:

a watertight tank means having a plurality of flue tubes extending vertically from one end to the other;

a burner means mounted beneath said tank;

a hot water outlet means mounted in the top portion of said tank;

an agitator assembly means mounted in the bottom portion of said tank, said agitator assembly means including a ring-shaped tubular member dimensioned to fit between the outer row of flue tubes and the inside wall of said tank means in the bottom thereof, said ring-shaped tubular member having a plurality of openings in a side thereof so that water flowing from inside said member into said tank will flow in a substantially horizontal direction towards the central portion of the tank in a plane which is closely adjacent to the tank bottom; and a connector means for connecting said agitator assembly means to a source of water.

2. A water heater according to claim 1 in which said agitator assembly means further includes a secondary tubular member connected at one end to said ring-shaped tubular member and extending horizontally therefrom between adjacent flue tubes towards the central portion of said tank, said secondary tubular member having a plurality of openings in the sides thereof so that water flowing from inside said secondary tubular member into said tank will flow in a substantially horizontal direction.

3. A water heater according to claim 1 in which there are a plurality of venturi fittings mounted in said openings in said ring-shaped tubular member, said fittings extending in a substantially horizontal plane towards the central portion of said tank, said venturi fittings each having a flow passageway therethrough which increases in diameter from its inlet to its outlet end and a plurality of side openings through which water is drawn from the tank when water is caused to flow from inside said ring through said passageway in said venturi fitting.

4. A water heater according to claim 3 in which said venturi fittings are made of anodic material.

5. A water heater according to claim 1 in which there are a plurality of anode members mounted on the top portion of said ring-shaped tubular member.

6. A water heater comprising:

a watertight tank means having a plurality of flue tubes extending vertically from one end to the other;

a burner means mounted beneath said tank;

a hot water outlet means mounted in the top portion of said tank;

an agitator assembly means mounted in the bottom portion of said tank, said agitator assembly means including a ring-shaped tubular member dimensioned to fit between the outer row of flue tubes and the inside wall of said tank means in the bottom thereof, said ring-shaped tubular member having a plurality of openings in a side thereof so that water flowing from inside said member into said tank will flow in a substantially horizontal direction towards the central portion of the tank in a plane which is closely adjacent to the tank bottom, said agitator assembly means further including a secondary tubular member connected at one end to said ring-shaped tubular member and extending horizontally therefrom between adjacent flue tubes towards the central portion of said tank, said secondary tubular member having a plurality of openings in the sides thereof so that water flowing from inside said secondary tubular member into said tank will flow in a substantially horizontal direction;

a plurality of venturi fittings mounted in said openings in said ring-shaped tubular member and in said secondary tubular member, said fittings extending in a substantially horizontal plane, said venturi fittings each having a flow passageway therethrough which increases in diameter from its inlet to its outlet end and a plurality of side openings through which water is drawn from the tank when water is caused to flow from inside said tubular members through said passageways in said venturi fittings; and a connector means connecting said agitator assembly means to a source of water.

7. A water heater according to claim 6 in which said venturi fittings are made of anodic material.

8. A water heater according to claim 6 in which there are a plurality of anode members mounted on the top portion of said ring-shaped tubular member and said secondary tubular member.

9. A water heater comprising:

a watertight tank means;

a source of heat for heating water inside said tank means;

a hot water outlet means located in the top portion of said tank;

an agitator assembly means mounted in the bottom portion of said tank, said agitator assembly means including a ring-shaped tubular member positioned closely adjacent the inside wall of said tank means in the bottom portion thereof, said ring-shaped tubular member having a plurality of openings in a side thereof so that water flowing from inside said member into said tank will flow in a substantially horizontal direction towards the central portion of the tank in a plane which is closely adjacent to the tank bottom; and a connector means for connecting said agitator assembly means to a source of water.

* * * * *

UNITED STATES PATENT AND TRADEMARK OFFICE

CERTIFICATE OF CORRECTION

PATENT NO. : 4,157,077

DATED : June 5, 1979

INVENTOR(S) : John R. Lindahl

It is certified that error appears in the above-identified patent and that said Letters Patent are hereby corrected as shown below:

In the drawings, sheet 1, Fig. 1, the reference numeral "20" applied to the burner in support base 24 should read -- 26 --.

Column 2, line 12, the reference numeral "36" should read -- 37 --.

In the drawings, sheet 2, Fig. 2, the reference numeral "37" should be applied to the end of tube portion 32.

Column 2, line 33, the reference numeral "44" should read -- 46 --.

Column 2, line 52, the word "gasses" should read -- gases --.

Signed and Sealed this

*Twenty-fifth* Day of *December 1979*

[SEAL]

*Attest:*

SIDNEY A. DIAMOND

*Attesting Officer*

*Commissioner of Patents and Trademarks*